US006446603B1

(12) United States Patent
Bonse et al.

(10) Patent No.: US 6,446,603 B1
(45) Date of Patent: Sep. 10, 2002

(54) FUEL INJECTION SYSTEM FOR INTERNAL COMBUSTION ENGINES, AND METHOD FOR INJECTING FUEL INTO THE COMBUSTION CHAMBER OF AN INTERNAL COMBUSTION ENGINE

(75) Inventors: Bernhard Bonse, Stuttgart; Walter Egler, Gerlingen; Peter Boehland, Steinheim; Klaus Wohlleber, Esslingen; Joerg Schmidt, Stuttgart; Karl Hofmann, Remseck, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/856,637

(22) PCT Filed: Sep. 19, 2000

(86) PCT No.: PCT/DE00/03243

§ 371 (c)(1),
(2), (4) Date: Sep. 7, 2001

(87) PCT Pub. No.: WO01/23753

PCT Pub. Date: Apr. 5, 2001

(30) Foreign Application Priority Data

Sep. 24, 1999 (DE) ..... 199 45 785

(51) Int. Cl.[7] ..... F02M 37/04
(52) U.S. Cl. ..... 123/446; 123/467
(58) Field of Search ..... 123/446, 447, 123/467

(56) References Cited

U.S. PATENT DOCUMENTS

| | | | | | |
|---|---|---|---|---|---|
| 3,893,629 | A | * | 7/1975 | Okamoto | 239/585 |
| 4,372,272 | A | * | 2/1983 | Walter et al. | 123/467 |
| 4,459,959 | A | * | 7/1984 | Terada et al. | 123/446 |
| 5,355,856 | A | * | 10/1994 | Paul et al. | 123/446 |
| 5,622,152 | A | * | 4/1997 | Ishida | 123/446 |

FOREIGN PATENT DOCUMENTS

DE 197 38 804 * 3/1999

* cited by examiner

*Primary Examiner*—Thomas N. Moulis
(74) *Attorney, Agent, or Firm*—Ronald E. Greigg

(57) ABSTRACT

A fuel injection system for internal combustion engines with a pressure step-up means is proposed, in which the fuel is pumped out of the low-pressure supplier into the injection nozzle via a feed line and is measured correctly in terms of time and quantity via a control line by the high-pressure part of the injection pump.

30 Claims, 5 Drawing Sheets

FUEL INJECTION SYSTEM FOR INTERNAL COMBUSTION ENGINES, AND METHOD FOR INJECTING FUEL INTO THE COMBUSTION CHAMBER OF AN INTERNAL COMBUSTION ENGINE

CROSS-REFERENCE TO RELATED APPLICATIONS

This application is a 35 USC 371 application of PCT/DE 00/03242 filed on Sep. 19, 2000.

BACKGROUND OF THE INVENTION

1. Field of the Invention

The invention relates to a fuel injection system for internal combustion engines and to a method for injecting fuel into the combustion chamber of an internal combustion engine.

2. Description of the Prior Art

As exhaust gas standards become more and more stringent, ever higher injection pressures are demanded to improve mixture formation and combustion. The result is greater mechanical and thermal stresses on the fuel injection system. In addition, the demand for drive capacity increases disproportionately, since with the pressure, the losses in the fuel injection system rise as well.

In a fuel injection system known from German Published, Nonexamined Patent Application DE-OS 197 38 804, a pressure step-up means is connected between the injection pump and the injection nozzle. As a result, the full injection pressure is applied only in the region around the injection nozzle. Fuel supply is effected through a bypass, directly from the highpressure region of the injection pump. When the pressure is increased in the injection pump, but also upon flow through the bypass, the fuel heats up greatly, which has negative impacts on the compressibility of the fuel and on its density.

The object of the invention is to furnish a fuel injection system in which the thermal stress on the injection pump is reduced and the possible pressure increase rates in the fuel injection system are improved. In addition, higher injection pressures should be made possible, and at the same time the stress on the injection pump and demand for drive power of the injection pump should be reduced.

SUMMARY OF THE INVENTION

According to the invention, the above objects are attained by a fuel injection system for internal combustion engines, having an injection nozzle and having an injection pump that has a high-pressure part, the high-pressure part of the injection pump being operatively connected to the injection nozzle via a control line, communicating with a low-pressure side of a pressure step-up means, and via a high-pressure path communicating with a high-pressure side of the pressure step-up means, and a feed line is present which feeds fuel to the injection nozzle. A first check valve disposed in the feed line prevents the reverse flow of fuel from the injection nozzle into the feed line, and the feed line communicates with a low-pressure supplier.

This fuel injection system has the advantage that the injection pressure is applied only between the high-pressure side of the pressure step-up means and the injection nozzle. At the same time, the pressure forces acting on the injection pump are reduced. As a result, the leakage and throttling losses are reduced as well, which leads to a reduction in the demand for drive capacity and improves the hydraulic efficiency of the fuel injection system. Furthermore, the fuel in the high-pressure region of the fuel injection system remains comparatively cold, since it is delivered directly from the low-pressure part of the injection pump. As a result, the compressibility of the fuel is less, which results in an improved pressure increase rate in the fuel injection system, and a greater mass flow can be pumped through the injection nozzle. In addition, the thermal and hydraulic improvement of the fuel injection system makes smaller injection port diameters of the injection nozzle possible, which improves the mixture formation at all operating points.

In one embodiment of the invention, the pressure step-up means has a step-up piston, which is displaceable in a bore and whose end faces each define one pressure chamber, whose first, larger end face of the step-up piston defines a first pressure chamber communicating with the control line, and whose second, opposed, smaller end face of the step-up piston defines a second pressure chamber, communicating with the high-pressure path.

In a further embodiment of the invention, it is provided that the feed line communicates with the second pressure chamber, so that the fuel is introduced in the part of the high-pressure region farthest away from the injection nozzle and is pumped from there as far as the injection nozzle. This has the advantage that in the highpressure region of the fuel injection system, the fuel is continuously replaced with relatively cold fuel.

Another embodiment provides that a first check valve is disposed in the feed line and prevents the reverse flow of fuel from the injection nozzle into the feed line, so that the low-pressure supplier of the injection pump is not acted upon by the injection pressure.

In one embodiment of the invention, the first check valve is spring-loaded, so that with maximum reliability under all operating conditions, the reverse flow of fuel from the injection nozzle into the feed line is prevented.

A further embodiment provides that the change in cross section of the step-up piston and a shoulder in a housing of the pressure step-up means define a relief chamber, so that possible leakage losses of the pressure step-up means can be collected and carried away.

In another embodiment of the invention, it is provided that the relief chamber communicates through a connecting line with the part of the feed line that is located between the low-pressure supplier and the first check valve, so that the leakage from the pressure step-up means is returned to the fuel injection system.

In one embodiment of the invention, a restoring spring is fastened in the relief chamber, is braced on a stationary support and in the process acts on the step-up piston at the change in cross section toward the relief chamber and as a function of the standing pressure in the control line, the end faces of the step-up piston, and the opening pressure of the first check valve presses the step-up piston against its stop toward the pump between injections, so that when the control line is pressure-relieved, the step-up piston is brought quickly, and independently of the pressure in the feed line, to its outset position. Moreover, the restoring spring requires only little installation space.

In a further embodiment of the invention, in the connecting line between the relief chamber and the feed line, a second check valve is provided, which blocks the communication in the direction from the feed line to the relief chamber, so that the feed line is not excited by the pressure fluctuations in the relief chamber.

A further embodiment of the invention provides that a scavenging valve designed as a check valve with a blocking direction from the control line to the feed line is disposed between the control line and the feed line, so that as soon as the pressure in the control line drops below the pressure in the feed line, filling of the control line is achieved through the scavenging valve. This leads to a drop in the temperature level in this region as well and thus improves the hydraulic performance of the fuel injection system and lessens the danger of seizing in the injection pump.

Further in the invention, it is provided that the scavenging valve does not open until an adjustable pressure difference between the control line and the feed line is reached, so that the motion of the step-up piston to its outset position is supported in this version as well by the pressure in the feed line, and the filling of the control line in the region between the injection pump and the pressure step-up means, which is difficult above all at high rpm, is assured since at high rpm the pressure in the feed pump is high as well.

A further embodiment of the invention provides that the part with the larger end face of the step-up piston upon which the pressure of the control line acts when the step-up piston is resting on its stop toward the pump is larger than the smaller end face of the step-up piston; that in the feed line between the first check valve and the injection pump, a third check valve with the same blocking direction is provided; and that between the control line and the first and third check valves, a connecting line with a fourth check valve with a blocking direction from the feed line to the control line is provided, so that at the beginning of injection, bypassing the pressure step-up means, fuel is pumped from the high-pressure part of the injection pump directly into the injection nozzle. As a result, the pressure increase rate changes at the onset of injection, and as a result the combustion noise can be abated, and furthermore it becomes easier to meter small preinjection quantities by means of provisions taken at the pump.

In a further feature of the invention, it is provided that the third and fourth check valves are combined into a bypass valve, so that the number of components is reduced, thus reducing expenses.

In another variant of the invention, the low-pressure supplier is part of the injection pump, so that the number of component groups is reduced, and a drive is required only for the high-pressure part of the injection pump and for the low-pressure supplier.

Further in the invention, a step-up piston embodied in two parts is provided, thus improving production, assembly and the hydraulic properties of the injection system.

In a further embodiment of the invention, it is provided that at least two injection nozzles are present; that one control line and one pressure step-up means each are disposed between each injection nozzle and the injection pump; and that all the injection nozzles communicate with the low-pressure supplier via feed lines.

The object stated at the outset is also attained by a method for injecting fuel into the combustion chamber of an internal combustion engine, by means of the fuel injection system in which

- a pressure relief of the control line takes place between injections;
- fuel is pumped out of the low-pressure supplier via the feed line to the injection nozzle;
- the step-up piston is moved to its stop toward the pump; and
- the fuel injection is controlled by the high-pressure part of the injection pump.

In this method, the full injection pressure is applied only directly in front of the injection nozzle; the maximum injection pressure is increased, and at the same time the load on the injection pump from pressure forces and temperatures is reduced. Furthermore, because of the reduced leakage and reduced throttling losses, the hydraulic efficiency of the system is improved and thus the requisite drive capacity is reduced further. The low temperature makes steeper pressure increases possible, because of the reduced elasticity of the fuel, and for the same pumping quantity, a higher flow rate through the nozzle is made possible. The thermal and hydraulic improvements in the fuel injection system allow smaller injection port diameters of the injection nozzles and thus better mixture formation at all operating points.

In a modification of the method of the invention, it is provided that until an adjustable pressure difference between the control line and the high-pressure side of the pressure step-up means is reached, the fuel injection is controlled, bypassing the pressure step-up means, by the high-pressure part of the injection pump; and that above the adjustable pressure difference between the control line and the high-pressure of the pressure step-up means, the fuel injection is controlled by the high-pressure part of the injection pump with the aid of the pressure step-up means. This method has the advantage that because of the different injection rate at the onset of injection, combustion noise is abated, and the metering of small preinjection quantities becomes easier through provisions made in the pump.

BRIEF DESCRIPTION OF THE DRAWINGS

Further advantages and advantageous features of the invention can be learned from the ensuing description, taken with the drawings, in which.

DESCRIPTION OF THE PREFERRED EMBODIMENTS

Figure 1:
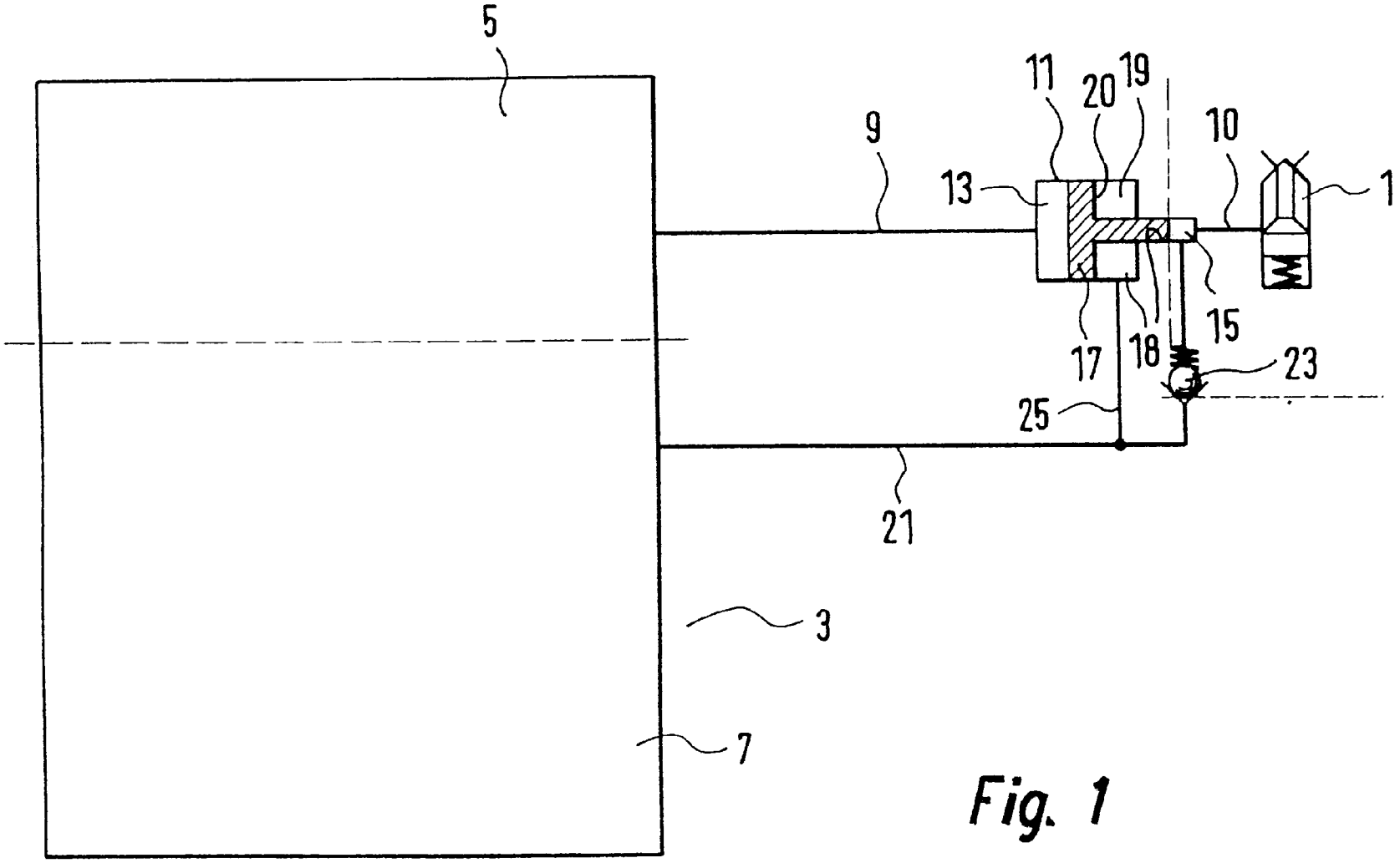
FIG. 1 is a schematic illustration of a first embodiment of the fuel injection system of the invention.

Referring now to the drawings in detail, FIG. 1 shows a fuel injection system with an injection nozzle 1 and an injection pump 3; the pump has a high- pressure part 5 and a low-pressure supplier 7. The low-pressure supplier 7 can also be embodied as a separate pump from the injection pump 3. In the exemplary embodiments described below, the low-pressure supplier 7 and high- pressure part 5 of the injection pump 3 are always shown as a unit. However, a version is also always conceivable in which the aforementioned separation of the low-pressure supplier 7 and injection pump 3 exists.

The high-pressure part 5 is operatively connected to the injection nozzle 1 via a control line 9 and a high- pressure path 10. A pressure step-up means 11 is disposed between the control line 9 and the high-pressure path 10. The pressure step-up means 11 has a first pressure chamber 13, a second pressure chamber 15, a step-up piston 17 is guided in a bore 18, and a relief chamber 19. The step-up piston 17 can be embodied in one or two parts. Two-part step-up pistons 17 comprise a first piston, which has the diameter of the first pressure chamber 13 of the pressure step-up means 11, and a further piston, which has the diameter of the second pressure chamber 15 of the pressure step-up means 11. The hydraulic force acting on the first piston is transmitted directly or indirectly to the second piston.

Two-part step-up pistons 17 can have advantages over one-part step-up pistons 17 in terms of production, assembly and hydraulic properties.

The first pressure chamber 13 and the end face, protruding into the first pressure chamber 13, of the step-up piston 17 form the low-pressure side of the pressure step-up means 11. The second pressure chamber 15 and the end face, protruding into the second pressure chamber 15, of the step-up piston 17 form the high-pressure side of the pressure step-up means 11.

Since the end face of the step-up piston 17 that is in hydraulic communication with the high-pressure part 5 of the injection pump 3 is larger than the end face of the step-up piston 17 protruding into the second pressure chamber 15, the pressure in the second pressure chamber 15 is higher than that of the high-pressure part 5 of the injection pump 3, in accordance with the proportion of the two end faces of the step-up piston 17.

The relief chamber 19 is defined by a change in cross section 20 of the step-up piston 17 and by a shoulder in a housing of the pressure step-up means 11.

Via a feed line 21, the second pressure chamber 15 is filled between injections with fuel from the low-pressure supplier 7 of the injection pump 3. Once both the second pressure chamber 15 and the high-pressure path 10 have been filled with fuel, the injection event can take place, in that the high-pressure part 5 of the injection pump 3 begins to pump fuel. In the pressure step-up means 11, the pressure is increased, and with this increased pressure the injection of the fuel into the combustion chamber takes place through the injection nozzle 1.

So that the feed line 21 and the low-pressure supplier 7 of the injection pump 3 will not be acted upon by the pressure of the second pressure chamber 15, a first check valve 23 is disposed in the feed line 21. The first check valve 23 can be spring-loaded, as shown in FIG. 1, or can be embodied without a spring, as suggested for instance in FIG. 2.

The high-pressure region of the fuel injection system of the invention is accordingly limited, in FIG. 1, to the region to the right of the step-up piston 17 and above the first check valve 23. This subject matter has been indicated by the dashed lines.

The leakages that occur between the step-up piston 17 and the housing of the pressure step-up means 11 accumulate in the relief chamber 19 and are transferred upon each injection event into the feed line 21 via a connecting line 25.

Once the injection has taken place, the step-up piston 17 moves back into its outset position. This occurs because the control line 9 is pressure-relieved, for instance via the high-pressure part 5 of the injection pump 3, and the step-up piston 17 is acted upon in the second pressure chamber 15 and the relief chamber 19, via the feed line 21, by the pressure of the low-pressure supplier 7 of the injection pump 3. Since the pressure in the feed line 21 is higher than the pressure in the pressure-relieved control line 9, the step-up piston 17 in FIG. 1 moves to the left, against its stop toward the pump. The pressure relief need not proceed as far as a lowering of the pressure to ambient pressure; instead, it can be provided that a standing pressure, which is above ambient pressure, is maintained during the pressure relief as well. A restoring spring can also be provided in addition in the relief chamber 19.

Figure 2:
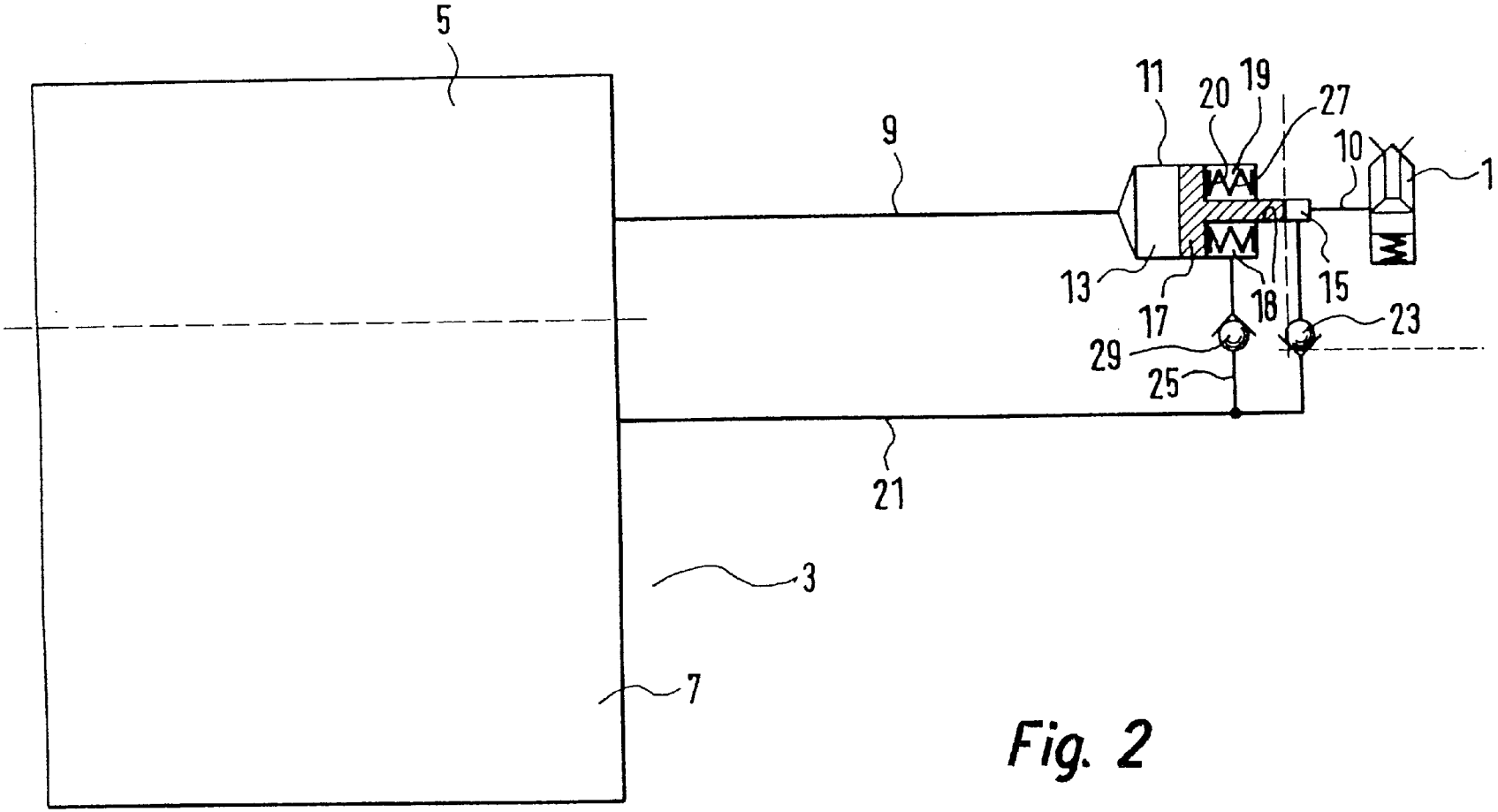
FIG. 2 is a schematic illustration of a second embodiment of the fuel injection system of the invention.

In FIG. 2, a second embodiment of the fuel injection system of the invention is shown. For component groups or components of the fuel injection system that are the same, the same reference numerals as in FIG. 1 have been used. The embodiment of FIG. 2 has a restoring spring 27 in the relief chamber 19 that acts on the step-up piston 17 counter to the injection motion. The restoring spring is fastened between a change in cross section 20 of the step-up piston 17 and a shoulder of the bore 18 or of the housing. By way of example, the restoring spring 27 can coaxially surround the step-up piston 17.

In the connecting line 25, there is a second check valve 29 in this embodiment, which prevents fuel from feed line 21 from reaching the relief chamber 19. After the end of injection, the step-up piston 17 is moved to its stop toward the pump by the pressure of the feed line 21 in the region of the second pressure chamber 15 and by the restoring spring 27. Because of the blocking action of the second check valve 29, vapor pressure prevails in the relief chamber 19 upon this motion of the step-up piston 17. Leakage flows that reach the relief chamber 19 from the first or second pressure chamber 13 or 15 are expelled via the second check valve 29 upon the injection.

An advantage of this embodiment is that the feed line 21 is not subjected to pressure fluctuations that are due to the oscillating motion of the step-up piston 17. Furthermore, because of the supporting effect of the pressure in the feed line 21, the restoring spring 27 can be designed with reduced prestressing and a lower spring rate and thus in a space-saving way.

Figure 3:
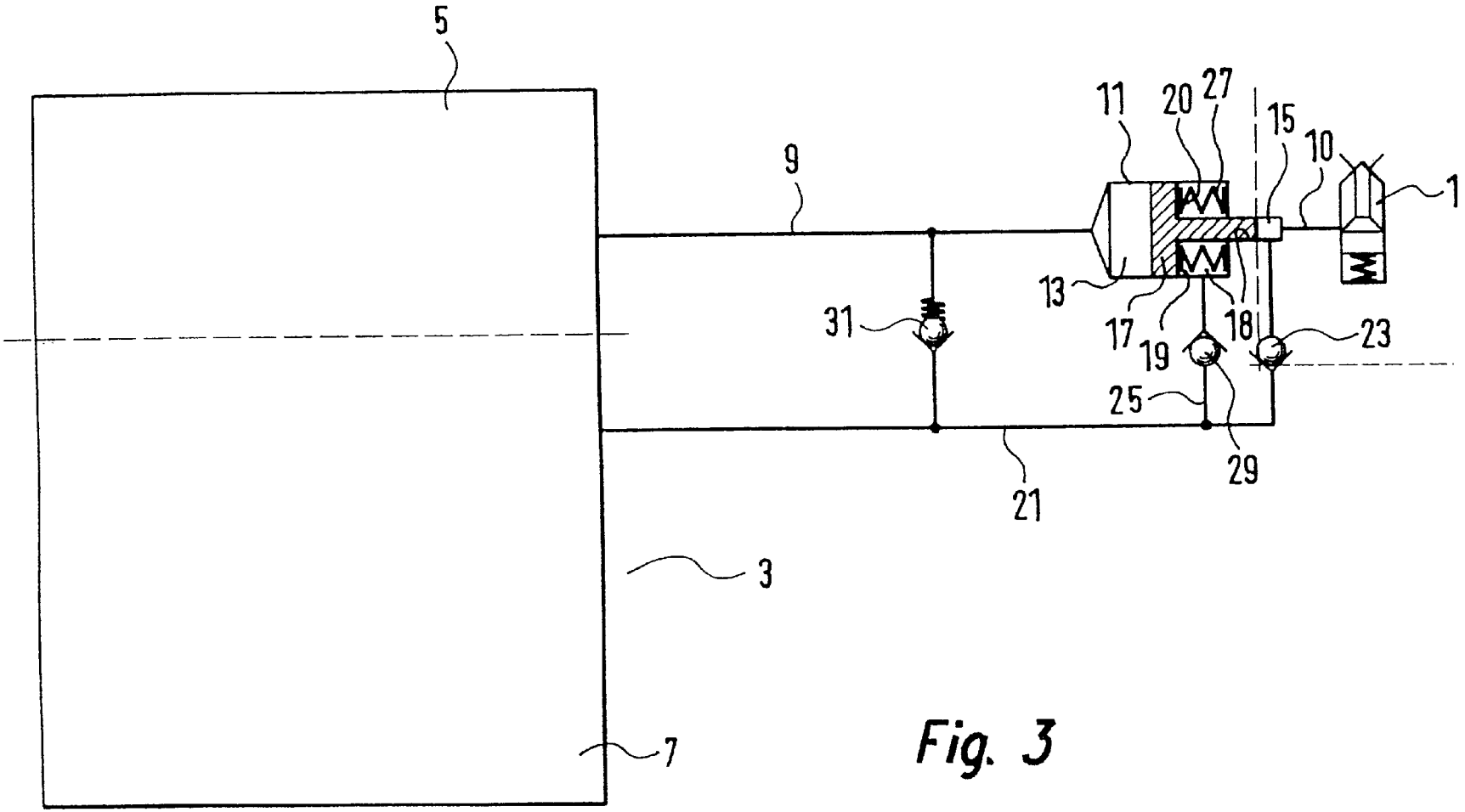
FIG. 3 is a schematic illustration of a third embodiment of the fuel injection system of the invention.

In FIG. 3, a further embodiment of the fuel injection system of the invention is shown. In addition to the elements and component groups of the fuel injection system explained in conjunction with FIGS. 1 and 2, in this embodiment a scavenging valve 31 is disposed between the control line 9 and the feed line 21. The scavenging valve 31 is spring-loaded, so that it opens when a pressure difference determined by the spring of the scavenging valve 31, such as 15 bar, between the feed line 21 and the control line 9 is reached. Once this pressure difference is reached, fuel is pumped from the feed line 21 into the control line 9. The thus-improved filling and scavenging of the control line 9 has the advantage over the embodiment of FIGS. 1 and 2 that in this region of the fuel injection system, the temperature level is lowered by the delivery of relatively cold fuel, thus improving the hydraulic performance. Furthermore, the risk of seizing in the high-pressure part 5 of the injection pump 3 is reduced, since this part of the injection system can be better scavenged as well. In addition, filling of the control line, which is especially difficult at high engine rpm, is assured.

Figure 4:
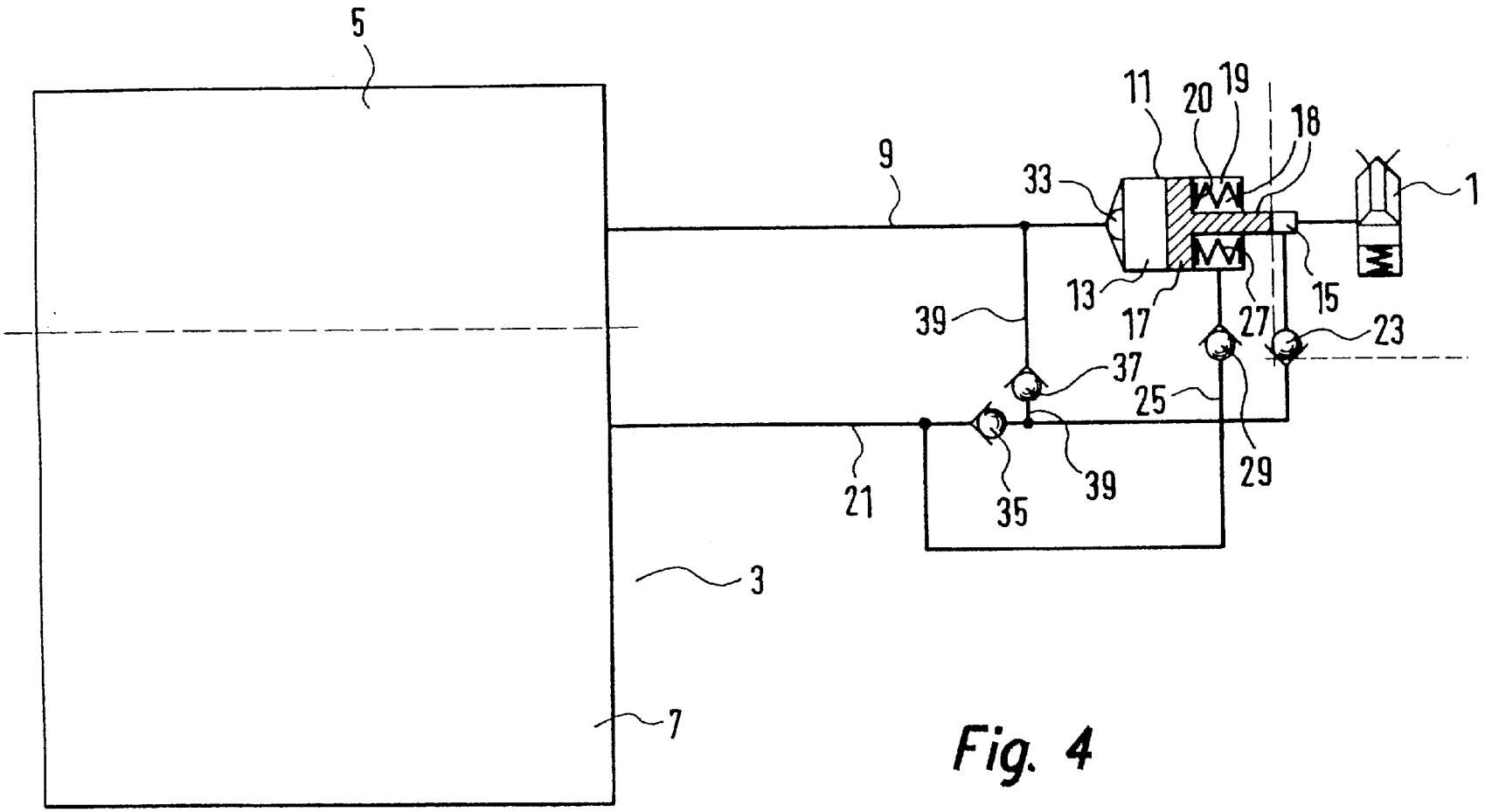
FIG. 4 is a schematic illustration of a fourth embodiment of the fuel injection system of the invention.

FIG. 4 shows a further embodiment of the fuel injection system of the invention. The pressure step-up means 11, in its first pressure chamber 13, has a pressure stage component 33. This pressure stage component 33 has the task of assuring that the step-up piston 17 leaves the stop toward the pump only when a certain pressure difference between the control line 9 and the second pressure chamber 15 is reached. This function can be achieved for instance by providing that the pressure stage component 33 covers part of the end face of the step-up piston 17, protruding into the first pressure chamber 13, once the step-up piston 17 is in its outset position, the remaining area of the step-up piston 17 being larger than the end face of the step-up piston 17 that protrudes into the second pressure chamber 15. By the choice of the proportions of these areas and the prestressing of the restoring spring 27, the pressure difference up to which the high-pressure side of the step-up piston 17, acted upon by the pressure of the feed line 21, and the restoring spring 27 keep the step-up piston 17 in its outset position counter to the pressure of the control line 9 is defined.

Also shown in FIG. 4 are a third and a fourth check valve 35 and 37. The third check valve 35 is disposed in the feed line 21 between the first check valve 23 and the injection pump 3, and it has the same blocking direction as the first check valve 23. The fourth check valve 37 is disposed in a connecting line 39 between the control line 9 and the feed line 21. The blocking direction of the fourth check valve 37 is selected such that no fuel can be fed from the feed line 21 into the control line 9 through the connecting line 39. The connecting line 25 branches off from the feed line 21 between the low-pressure supplier 7 and the third check valve 35.

The cooperation of the pressure stage component 33 and of the third and fourth check valves 35 and 37 has the effect that at the onset of injection, when the pressure in the control line 9 rises, first the fuel, under pressure, in the control line 9 is fed, bypassing the pressure step-up means 11, through the connecting line 39 and part of the feed line 21 into the second pressure chamber 15 and from there is fed to the injection nozzle 1. As soon as the force, resulting from the difference in the effective areas of the pressure stage component 33 and the end face of the step-up piston 17 protruding into the second pressure chamber 15, and from the prestressing of the restoring spring 27, suffices to overcome the prestressing of the restoring spring 27, the step-up piston 17 moves out of its outset position. Thus the full end face of the step-up piston 17 protruding into the first pressure chamber 13 is acted upon by the pressure of the control line 9. As a consequence, the pressure step-up means becomes operative, since the first check valve 23 prevents the further inflow of fuel via the feed line 21 into the second pressure chamber 15. The bypassing of the pressure step-up means 11 at the onset of the injection cycle changes the rate of pressure increase of the fuel in the second pressure chamber 15 and thus in the injection nozzle 1 as well. As a result, the metering of small preinjection quantities through provisions taken in the pump is made easier, and the combustion noise can be abated.

Figure 5:
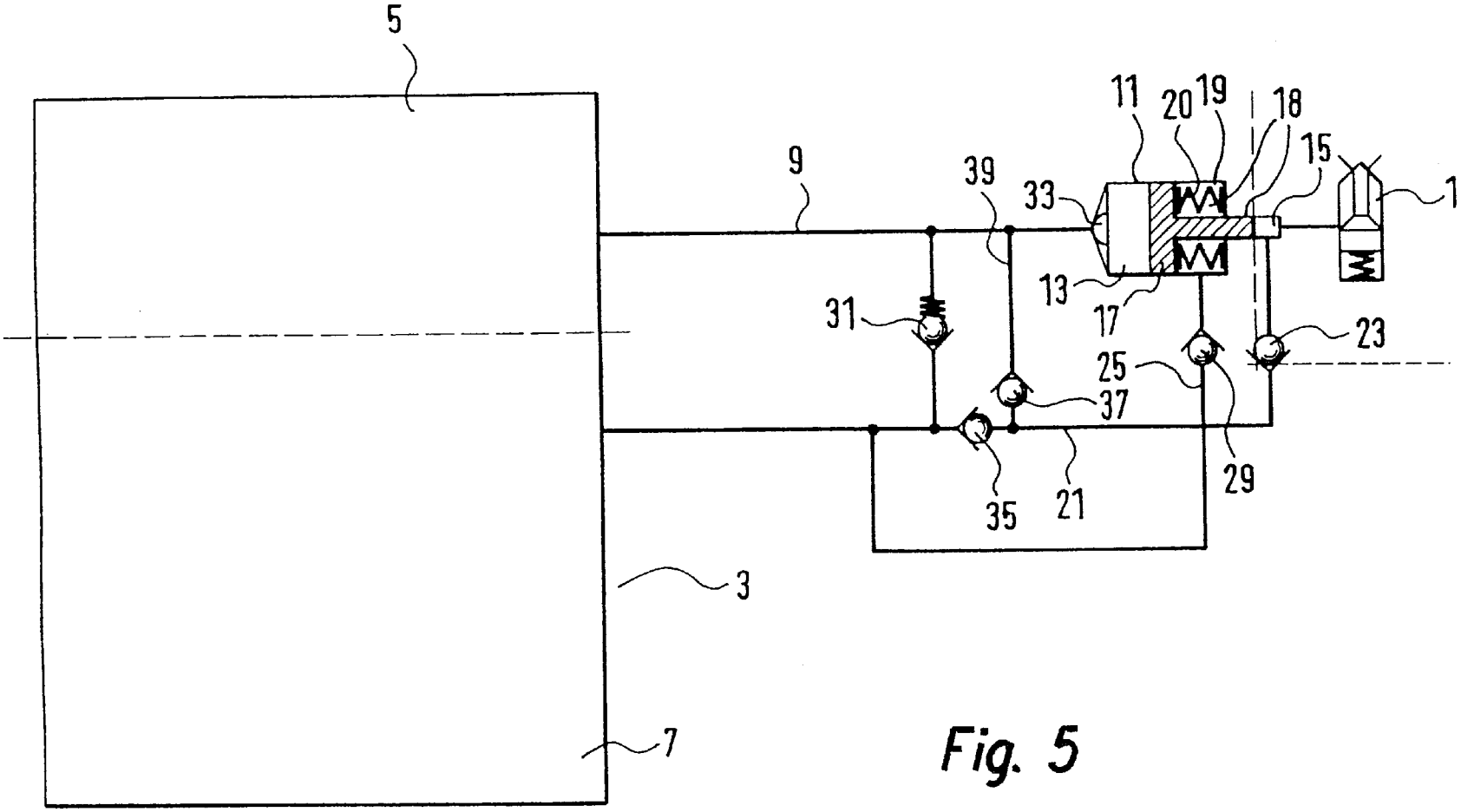
FIG. 5 is a schematic illustration of a combination of various embodiments of a fuel injection system of the invention.

The embodiment of the fuel injection system of the invention shown in FIG. 5 represents the combination of the embodiments shown in FIGS. 2, 3 and 4. The intent is to show clearly that these embodiments can be combined freely with one another. This is equally true to the embodiment shown in FIG. 1.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for internal combustion engines, having an injection nozzle (1) and having an injection pump (3) that has a high-pressure part (5), the high-pressure part (5) of the injection pump (3) being operatively connected to the injection nozzle (1) via a control line (9), communicating with a low-pressure side of a pressure step-up means (11), and via a high-pressure path (10) communicating with a high-pressure side of the pressure step-up means (11), and a feed line (21) being present which feeds fuel to the injection nozzle (1), the improvement wherein the feed line (21) communicates with a low-pressure supplier (7).

2. The fuel injection system of claim 1, wherein the pressure step-up means (11) has a step-up piston (17), which is displaceable in a bore (18) and whose end faces each define one pressure chamber; that a first, larger end face of the step-up piston (17) defines a first pressure chamber (13) communicating with the control line (9); and that a second, opposed, smaller end face of the step-up piston (17) defines a second pressure chamber (15), communicating with the high-pressure path (10).

3. The fuel injection system of claim 2, wherein the feed line (21) communicates with the second pressure chamber (15).

4. The fuel injection system of claim 1, wherein a first check valve (23) is disposed in the feed line (21) and prevents the reverse flow of fuel from the injection nozzle (1) into the feed line (21).

5. The fuel injection system of claim 4, wherein the first check valve (23) is spring-loaded.

6. The fuel injection system of claim 2, wherein the change in cross section of the step-up piston (17) and a shoulder in a housing of the pressure step-up means (11) define a relief chamber (19).

7. The fuel injection system of claim 6, wherein the relief chamber (19) communicates through a connecting line (25) with the part of the feed line (21) that is located between the low-pressure supplier (7) and the first check valve (23).

8. The fuel injection system of claim 7, wherein a restoring spring (27) is fastened in the relief chamber (19), is braced on a stationary support and in the process acts on the step-up piston (17) at the change in cross section toward the relief chamber and as a function of the standing pressure in the control line (9), the end faces of the step-up piston (17), and the opening pressure of the first check valve (23) presses the step-up piston (17) against its stop toward the pump between injections.

9. The fuel injection system of claim 7, wherein in the connecting line (25) between the relief chamber (19) and the feed line (21), a second check valve (29) is provided, which blocks the communication in the direction from the feed line (21) to the relief chamber (19).

10. The fuel injection system of claim 1, wherein a scavenging valve (31) designed as a check valve with a blocking direction from the control line to the feed line (21) is connected between the control line (9) and the feed line (21).

11. The fuel injection system of claim 10, wherein the scavenging valve (31) does not open until an adjustable pressure difference between the control line (9) and the feed line (21) is reached.

12. The fuel injection system of claim 1, wherein the part with the larger end face of the step-up piston (17) upon which the pressure of the control line (9) acts when the step-up piston (17) is resting on its stop toward the pump is larger than the smaller end face of the step-up piston (17); that in the feed line (21) between the first check valve (23) and the injection pump (3), a third check valve (35) with the same blocking direction is provided; and that between the control line (9) and the first and third check valves (23, 35), a connecting line with a fourth check valve (37) with a blocking direction from the feed line (21) to the control line is provided.

13. The fuel injection system of claim 12, wherein the third and fourth check valves are combined into a bypass valve.

14. The fuel injection system of claim 1, wherein the low-pressure supplier (7) is part of the injection pump (3).

15. The fuel injection system of claim 1, wherein the step-up piston (17) is embodied in two parts.

16. The fuel injection system of claim 1, wherein at least two injection nozzles (1) are present; that one control line (9) and one pressure step-up means (11) each are disposed between each injection nozzle (1) and the injection pump (3); and that all the injection nozzles (1) communicate with the low-pressure supplier (7) via feed lines (21).

17. A method for injecting fuel into the combustion chamber of an internal combustion engine, by means of the fuel injection system having an injection nozzle (1) and an injection pump (3) including a high pressure part (5), the high pressure part being operatively connected to the injection nozzle (1) via a control line (9) communicating with a low pressure side of a pressure step-up means (11) and via a high pressure path (10) communicating with a high pressure side of the pressure step-up means (11), and a feed line (21) communicating with a low pressure supplier (7) feeding fuel to the injection nozzle (1), the method comprising the steps of:

pressure relieving the control line (9) between injections;

pumping fuel from the low-pressure supplier (7) via the feed line (21) to the injection nozzle (1);

moving of the step-up piston (17) to its stop toward the pump;

controlling of the fuel injection by the high- pressure part (5) of the injection pump (3).

18. The method for injecting fuel into the combustion chamber of an internal combustion engine of claim 17, further comprising;

until an adjustable pressure difference between the control line (9) and the high-pressure side of the pressure step-up means (11) is reached, the fuel injection is controlled, bypassing the pressure step-up means (11), by the high-pressure part (5) of the injection pump (3); and that above the adjustable pressure difference between the control line (9) and the high-pressure of the pressure step-up means (11), the fuel injection is controlled by the high-pressure part (5) of the injection pump (3) with the aid of the pressure step-up means.

19. The fuel injection system of claim 2, wherein a first check valve (23) is disposed in the feed line (21) and prevents the reverse flow of fuel from the injection nozzle (1) into the feed line (21).

20. The fuel injection system of claim 3, wherein a first check valve (23) is disposed in the feed line (21) and prevents the reverse flow of fuel from the injection nozzle (1) into the feed line (21).

21. The fuel injection system of claim 3, wherein the change in cross section of the step-up piston (17) and a shoulder in a housing (12) of the pressure step-up means (11) define a relief chamber (19).

22. The fuel injection system of claim 4, wherein the change in cross section of the step-up piston (17) and a shoulder in a housing of the pressure step-up means (11) define a relief chamber (19).

23. The fuel injection system of claim 22, wherein the relief chamber (19) communicates through a connecting line (25) with the part of the feed line (21) that is located between the low-pressure supplier (7) and the first check valve (23).

24. The fuel injection system of claim 22, wherein a restoring spring (27) is fastened in the relief chamber (19), is braced on a stationary support and in the process acts on the step-up piston (17) at the change in cross section toward the relief chamber and as a function of the standing pressure in the control line (9), the end faces of the step-up piston (17), and the opening pressure of the first check valve (23) presses the step-up piston (17) against its stop toward the pump between injections.

25. The fuel injection system of claim 24, wherein in the connecting line (25) between the relief chamber (19) and the feed line (21), a second check valve (29) is provided, which blocks the communication in the direction from the feed line (21) to the relief chamber (19).

26. The fuel injection system of claim 2, wherein a scavenging valve (31) designed as a check valve with a blocking direction from the control line to the feed line (21) is connected between the control line (9) and the feed line (21).

27. The fuel injection system of claim 4, wherein a scavenging valve (31) designed as a check valve with a blocking direction from the control line to the feed line (21) is connected between the control line (9) and the feed line (21).

28. The fuel injection system of claim 7, wherein a scavenging valve (31) designed as a check valve with a blocking direction from the control line to the feed line (21) is connected between the control line (9) and the feed line (21).

29. The fuel injection system of claim 2, wherein the part with the larger end face of the step-up piston (17) upon which the pressure of the control line (9) acts when the step-up piston (17) is resting on its stop toward the pump is larger than the smaller end face of the step-up piston (17); that in the feed line (21) between the first check valve (23) and the injection pump (3), a third check valve (35) with the same blocking direction is provided; and that between the control line (9) and the first and third check valves (23, 35), a connecting line with a fourth check valve (37) with a blocking direction from the feed line (21) to the control line is provided.

30. The fuel injection system of claim 12, wherein at least two injection nozzles (1) are present; that one control line (9) and one pressure step-up means (11) each are disposed between each injection nozzle (1) and the injection pump (3); and that all the injection nozzles (1) communicate with the low-pressure supplier (7) via feed lines (21).

* * * * *